US011247756B1

(12) United States Patent
Olivo et al.

(10) Patent No.: US 11,247,756 B1
(45) Date of Patent: Feb. 15, 2022

(54) LIFE VEST MARKER

(71) Applicant: Mary E. Olivo, Mendon, NY (US)

(72) Inventors: Mary E. Olivo, Mendon, NY (US); Robert M. Heil, Mendon, NY (US); Peter Samuel Carosa, Honeoye Falls, NY (US); Tyler Andrew Wolfe, Stanley, NY (US); Todd W. Alexander, Keuka Park, NY (US)

(73) Assignee: Mary E. Olivo, Mendon, NY (US)

( * ) Notice: Subject to any disclaimer, the term of this patent is extended or adjusted under 35 U.S.C. 154(b) by 0 days.

(21) Appl. No.: 17/461,274

(22) Filed: Aug. 30, 2021

(51) Int. Cl.
*B63C 9/20* (2006.01)
*B63C 9/11* (2006.01)

(52) U.S. Cl.
CPC . *B63C 9/20* (2013.01); *B63C 9/11* (2013.01)

(58) Field of Classification Search
CPC ..... B63C 9/11; B63C 9/20
See application file for complete search history.

(56) References Cited

U.S. PATENT DOCUMENTS 5,083,956 A * 1/1992 Chraghchian ..... B63C 9/20 116/209
5,671,480 A * 9/1997 Krout ..... A41D 13/0125 116/173
5,800,227 A 9/1998 Brown
5,893,786 A * 4/1999 Stevens ..... B63C 9/20 441/89
6,749,473 B1 * 6/2004 Lower ..... B63C 9/20 116/173
7,812,732 B1 * 10/2010 Brouillard ..... B63C 9/20 340/573.6
10,207,780 B2 * 2/2019 Leyva ..... B63C 9/1255
10,286,987 B2 * 5/2019 Duff ..... B63C 9/115
10,562,601 B2 * 2/2020 McLaughlin ..... B63C 9/11
2011/0097952 A1 * 4/2011 Pirie ..... B63C 9/20 441/89

* cited by examiner

*Primary Examiner* — S. Joseph Morano
*Assistant Examiner* — Jovon E Hayes
(74) *Attorney, Agent, or Firm* — Tracy Jong Law Firm; Tracy P. Jong; Cheng Ning Jong

(57) ABSTRACT

A marker system including a sleeve including a slot, a board, at least one hole, an upper end and a lower end, the slot including an opening disposed on the upper end, the board configured to slide within the slot and through the opening, the at least one hole disposed on the lower end to allow entry of fluid into the slot to urge the board through the opening and exit of the fluid from the slot and the sleeve is configured to be secured to a life vest, wherein when the sleeve is disposed in a body of fluid with the opening faces upwardly, the board extends through the opening, serving as a marker to get attention of one or more users around the life vest and when the sleeve is disposed outside of the body of fluid.

12 Claims, 15 Drawing Sheets

LIFE VEST MARKER

BACKGROUND OF THE INVENTION

1. The Field of the Invention

The present invention relates to a non-intrusive and compact device useful for automatically deploying an attention-getting device when it is submerged and retracting the attention-getting device when it is no longer submerged. More specifically, the present invention is directed to a non-intrusive, compact, customizable and modifiable device useful for automatically deploying an attention-getting device when it is submerged and retracting the attention-getting device when it is no longer submerged.

2. Background Art

Life vests or jackets have been used to save lives from drowning for decades. For aesthetic purposes, they generally come in colors that are rather subtle and sometimes blend in with their environment. Life vests that come in bright colors, e.g., orange, tend to be significantly less noticeable once the life vests become submerged. It is especially important for life vests to be noticeable when its wearer is involved in a sport or activity where he or she can be routinely thrown off skis, e.g., in water skiing and waiting to be picked up. It is imperative that the water skier be retrieved quickly to avoid potential accidental impact with the water skier by passing watercraft if the water skier is not noticed. Watercraft used for water skiing or most watercraft can be operated at high speeds or speeds that give the operators little time to react to their environments. Therefore a person that has fallen in a body of water where high speed boat traffic can occur, must be located and picked up expediently. The first step in retrieving one in the water remains the ability for the party retrieving the person in the water, to spot the person in the water. Various attempts have been made to provide flags or markers that are integrated with life vests or life jackets, none of which are particularly suitable to aid in locating their users as they interfere with their users and they alter the air flow around water skiers, e.g., by increasing air resistance to the users due to their profiles.

U.S. Pat. No. 5,893,786 to Stevens (Hereinafter Stevens) discloses an automatic, telescoping, buoyant identification device for use with a water sports life vest. The device is used in conjunction with a conventional life vest/floatation device where a telescoping spotting pole or flag is mounted to the back of the vest. The spotting pole, constructed of a buoyant foam, slides freely within a tubular main housing such that when the wearer becomes submerged, the spotting pole automatically telescopes from the main housing into the air. The spotting pole has a visible identification device, such as a flag, mounted on its end. The identification device is colored in a manner such that it will be highly visible to approaching boaters. Stevens' device may also be sold as an add-on kit. The unit will attach to existing life vests using fastening devices, such as hook and loop fasteners, ties or belts. Here, the entire pole acts as a flotation device and therefore more substantial in its overall size. Further, as sufficient flotation is required to raise the flag while flotation is provided by a pole, Stevens' flag protrudes beyond a top edge of the life jacket, even while the flag is disposed in its at rest position, potentially interfering with a user of the life vest. Yet further, as all the flotation required is provided by a pole, the pole is necessarily large in its diameter, a user of Steven's flag may not comfortably lean back while seated in a seat with a back. Yet further, for a user where aerodynamics around the user is important, e.g., a user on the move while water skiing or riding a jetski, etc., may not tolerate a life jacket with a flag protruding from the user and altering the aerodynamics of the user as a whole, e.g., in increasing wind resistance experienced by the user.

U.S. Pat. No. 5,083,956 to Chraghchian (Hereinafter Chraghchian) discloses a self elevating signalling device for water skiers, making them more visible if and when they fall off their skies into the water. The device includes an enlarged visual luminescent marker including an outer guide tube and a buoyant tube freely mounted inside the guide tube secured to a flotation jacket and positioned in a vertical position when the fallen skier is in the water. The guide tube has an opening formed therein below the surface of the water permitting the guide tube to fill with water, causing the buoyant tube to rise inside the guide tube. The length of the buoyant tube is such that the water inside the guide tube lifts the buoyant tube above the head of the person wearing the flotation jacket enabling rescuers to locate him. Chraghchian's device is not unlike Stevens' device. Chraghchian's device again includes a portion of the device, e.g., a marker which protrudes beyond a top edge of the flotation jacket to which the device is attached, even while the marker is disposed in its at rest position, potentially interfering with a user of the life vest. The water-entry point of Chraghchian's guide tube must be submerged to allow the buoyant tube to float. In an emergency situation, it may be unlikely for this condition to occur upon the start of the emergency situation due to the orientation and position of the guide tube with respect to the body of water the user finds himself or herself in. Again, as the buoyant tube is generally cylindrically-shaped and narrow, the buoyant tube is necessarily large in its diameter, a user of Chraghchian's device may not comfortably lean back while seated in a seat with a back. Yet further, for a user where aerodynamics around the user is important, e.g., a user on the move while water skiing or riding a jetski, etc., may not tolerate a life jacket with a marker protruding from the user and altering the aerodynamics of the user as a whole, e.g., in increasing wind resistance experienced by the user.

U.S. Pat. No. 6,749,473 to Lower (Hereinafter Lower) discloses a signaling device for enhancing the visibility of the wearer of the device. A flexible coilable resilient rod is provided with a flag. The rod is designed to be coilable or collapsible into a compact configuration and stored within and confined by a container. The container is provided with a quick opening closure which permits release of pressure on the rod, allowing the rod to spring into an erect position. In addition to having a flag and rod that extend beyond a top edge of the flotation jacket to which the device is attached, the flag can be automatically released using a water soluble pellet, a mechanism for raising the flag that is prone to failures.

U.S. Pat. No. 10,562,601 to McLaughlin (Hereinafter McLaughlin) discloses a personal flotation device, in the form of a vest or like garment, and having a quiver-like receptacle attachment, hinged to the garment for flexibility. The quiver attachment houses a mast and flag attached to a small flotation device, such that when the user enters the water, the flotation device causes the mast and attached flag to rise so that the flag can be seen from a distance and the wearer identified thereby. The quiver element is attached such that it can place the extended mast and flag unobtrusively and at a distance from the wearer's head for comfort. The quiver element comprises a housing for the mast and flotation device and is permeable to water; the quiver element is shaped to guide the mast and flag linearly at an angle to the longitudinal axis of the wearer. The device allows for the flag to be interchanged with other flags so as to better identify the wearer from other users. McLaughlin discloses an embodiment of a flag that can be passively raised once the flag is exposed to water or one which does not require electric power. Again, for a user where aerodynamics around the user is important, e.g., a user on the move while water skiing or riding a jetski, etc., may not tolerate a life jacket with a flag protruding from the user and altering the aerodynamics of the user as a whole, e.g., in increasing wind resistance experienced by the user.

U.S. Pat. Pub. No. 20110097952 of Pirie (Hereinafter Pirie) discloses a device that can be permanently (or temporarily) attached to the back of a life jacket that deploys a staff or rod which sticks up high enough above the floater's head as to make them readily visible in the water. This staff or rod is generally water-activated in the sense that it is made of highly buoyant material that is forced upward out of a tube attached to the back of the jacket when in the water, and falls back down in the tube when out of the water. The staff can be brightly colored and can optionally hold a flag or other device to further increase visibility. The staff and/or flag can also have reflective portions for visibility at night. Pirie discloses another version of a flag that can be passively raised once the flag is exposed to water. Again, Pirie discloses a device having a tube centrally disposed on the back portion of a life jacket and therefore Pirie's device has all of the disadvantages associated with a flag or marker system having similar constructs.

U.S. Pat. No. 10,286,987 to Duff (Hereinafter Duff) discloses a Visual Awareness Safety Accessory (VASA) for use by a person engaged in watersport/water-based activity. The device may be worn by itself or in combination with a personal flotation device (PFD). The VASA includes a user worn deployable highly visible flag element which is lifted via an attached float when a wearer enters the water. The float raises the flag element well above a user's head whereupon the user can be more easily seen by others using the same waterway. The higher visibility more easily enables location identification of the wearer for rescue, retrieval, and/or collision avoidance. Duff discloses an automatically-deployed flag that is hinged along a seam disposed on a surface of the PFD rather than a flag that is attached to a pole as disclosed elsewhere herein. Duff's system includes a large flag element or cape pivotably connected to a life jacket at one edge of the cape and the cape is pivotably connected to a float component somewhere between this edge and a second edge. To raise or lower the cape, Duff's system involves a generally vertically-aligned motion of the float component and a rotary motion of the cape, rendering Duff's system uncompact in its form during operations.

U.S. Pat. No. 10,207,780 to Leyva (Hereinafter Leyva) discloses an emergency rescue locator for locating persons and pets in the water. The emergency rescue locator comprises a life jacket having a front side and a rear side and a locating system mounted to the life jacket. The locating system comprises an inflatable pole having a first end and a second end and an inflating mechanism in fluid communication with the first end of the pole. Upon the locating system becoming immersed in the water, the inflating mechanism instantly and automatically activates to inflate the pole causing the second end of the pole to be positioned at a point above a water surface. The locating system immediately and continuously pinpoints the persons' or pets' location until rescued. Levya's device is useful for automatically inflating a pole having a ring at its distal end. The inflating mechanism is an active means, thus requiring power to be provided to it for it to function. Again, for a user where aerodynamics around the user is important, e.g., a user on the move while water skiing or riding a jetski, etc., may not tolerate a life jacket with a flag protruding from the user and altering the aerodynamics of the user as a whole, e.g., in increasing wind resistance experienced by the user.

U.S. Pat. No. 7,812,732 to Brouillard (Hereinafter Brouillard) discloses an apparatus having a shell, an indicator and straps. The shell has flanges at the top and bottom, respectively, constricting the hole size at the ends of the shell. The shell can be comprised of a body and a cap. The indicator is in telescoping engagement with the shell. The indicator has two ends. The first end of the indicator protrudes from the second end of the shell. A weight is at the second end of the indicator. The weight has a sidewall with an outer periphery greater in size than the inner periphery of the shell ends. The straps are used to secure the apparatus to a person. The indicator extends from the shell when the person enters the water. The indicator, aided by the weight, retracts into the shell when the person exits the water. The shell can have wings. Here, Brouillard's mast is an air tube where the air is retained. The weight that is attached to the bottom end brings the tube down when the tube is disposed in water. Again, Brouillard discloses a device having a tube centrally disposed on the back portion of a life jacket and therefore Brouillard's device has all of the disadvantages associated with a flag or marker system having similar constructs.

U.S. Pat. No. 5,800,227 to Brown Jr. (Hereinafter Brown) discloses a self-erecting personal water safety device includes a marker device having a flag portion and a base portion normally in the collapsed state; an erection chamber in the flag portion and a compressible storage chamber in the base portion for storing an actuating fluid and interconnected with the erection chamber for compressing when submerged in water to transfer fluid to the erection chamber and erect the flag portion. Brown's flag portion extends well beyond the vest, making it particularly ill-suited for use in active applications where aerodynamics can be a concern. Brown's device may also be uncomfortable for use with a normal seat as the thickness of Brown's device may prevent a user from leaning back against the seat for comfort.

There exists a need for a visual marker system adaptable to a flotation or life jacket such that its user can be easily located to be retrieved or avoided where the visual marker system does not significantly negatively affecting the aerodynamics, comfort, convenience and safety offered by the life jacket to which the visual marker system is adapted.

SUMMARY OF THE INVENTION

In accordance with the present invention, there is provided a marker system including a sleeve including a slot, a board, at least one hole, an upper end and a lower end, the slot including an opening disposed on the upper end, the board configured to slide within the slot and through the opening, the at least one hole disposed on the lower end to allow entry of fluid into the slot to urge the board through the opening and exit of the fluid from the slot and the sleeve is configured to be secured to a life vest, wherein when the sleeve is disposed in a body of fluid with the opening faces upwardly, the board extends through the opening, serving as a marker to get attention of one or more users around the life vest and when the sleeve is disposed outside of the body of fluid, at least a portion of the fluid is drained through the at least one hole when the opening faces upwardly to prevent the marker system from taking on additional load due to the fluid.

In one embodiment, the board includes a material having a density of no more than about 15 lb/ft$^3$ (240 kg/m$^3$). In one embodiment, the board includes a slot and the sleeve includes a retainer configured to be disposed within the slot of the board to prevent detachment of the board from the sleeve. In one embodiment, the retainer is configured to be disposed substantially at the upper end and the slot is configured to span substantially the distance between the upper end and the lower end of the sleeve, enabling the board to slide a maximum distance substantially the distance between the upper end and the lower end of the sleeve. In one embodiment, the sleeve includes two covers configured to be removably coupled to form the slot with a latch system, a first of the two covers is configured to be removable from a second of the two covers to enable replacement of the board. In one embodiment, the latch system includes a snap lock. In one embodiment, the minimum ratio of the area of the at least one hole and the volume of said board is about 0.000394 mm$^2$ (0.01 in$^2$) of the at least one hole/mm$^3$ (in$^3$) of the volume of the board.

An object of the present invention is to provide an attention-getting device that can be coupled to a life vest.

Another object of the present invention is to provide an attention-getting device that can be integrally built with a life vest.

Another object of the present invention is to provide an attention-getting device that is automatically activated once a portion of it is submerged in water and retracted once it is no longer submerged.

Another object of the present invention is to provide a passive attention-getting device that is automatically activated once a portion of it is submerged in water and retracted once it is no longer submerged.

Another object of the present invention is to provide an attention-getting device that is compact and does not extend vertically beyond the back portion of a life vest to which the attention-getting device is attached.

Another object of the present invention is to provide an attention-getting device that is customizable and/or modifiable.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—flag system or marker system
4—board or marker or flag
6—case
8—front cover
10—rear cover
12—snap lock
14—snap
16—slot for receiving snap
18—life vest
20—hole
22—pin or retainer
24—slot
26—upper end of rear cover
28—lower end of rear cover
30—strap belt
32—buckle
34—top edge of life vest
36—distance between top edge of life vest and top edge of board

38—user
40—upper end of sleeve
42—lower end of sleeve
44—body of water
46—tab
48—thickness of board
50—thickness of marker system
52—markings
54—surface

PARTICULAR ADVANTAGES OF THE INVENTION

The present marker system enables the flag to be replaced to suit an application the marker system is utilized. Therefore, the sleeve can be used even if the patterns or markings or color/s of the board are required to be altered.

The present marker system is non-intrusive and does not alter the benefits provided by a life jacket to which the present marker system is attached or a life jacket the present marker system is a part of. For instance, during use and while not disposed in water, the present marker system does not change the manner a user will lean in water due to the life jacket of the user. In one aspect, a life vest, when worn properly, shall keep the user's head out of water. The present marker system is non-intrusive as the flag extends upwardly on the back of a life vest and the portion of the flag that extends outside of its sleeve does not interfere with its user.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower). The term "user" is used herein to mean a "wearer" of a life vest or life jacket with or without a marker system attached thereon. The term "flag" is used interchangeably with the term "marker" to mean an attention-getting object that is capable to be visually distinguished from its environment by an observer, e.g., by using a contrasting color and patterns, etc.

Figure 1:
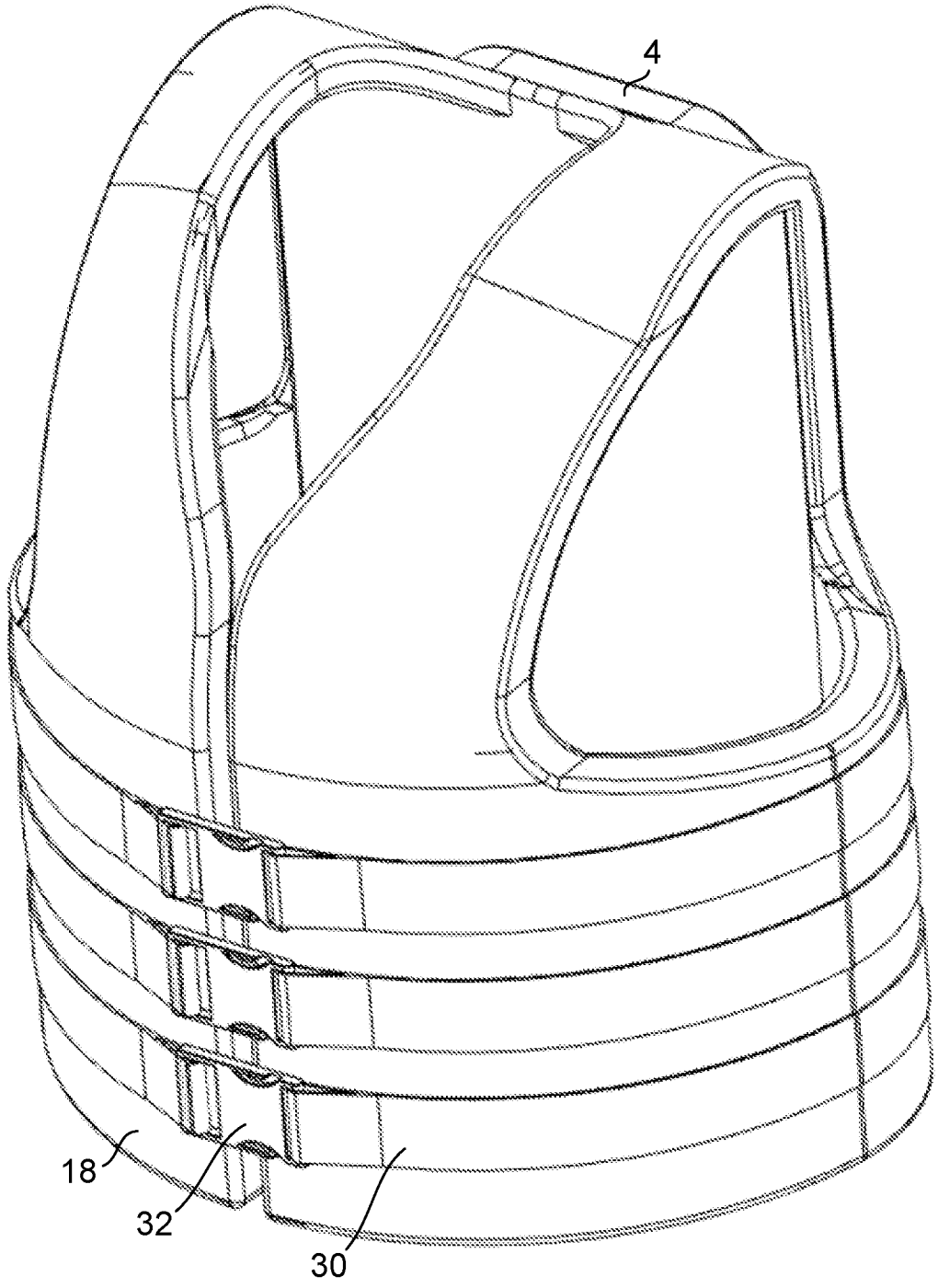
FIG. 1 is a top front perspective view of a life vest equipped with a marker system.
Figure 2:
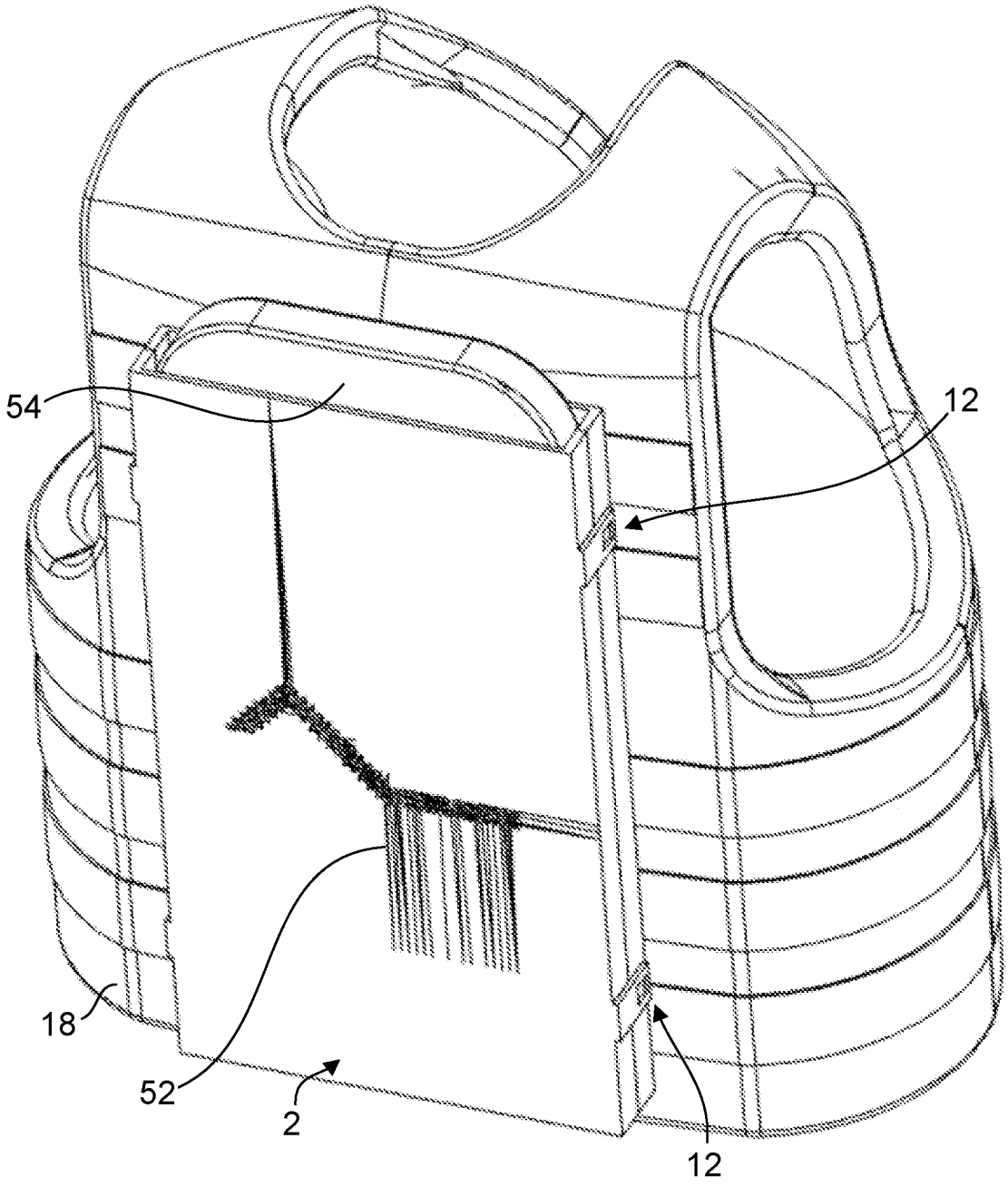
FIG. 2 is a top right rear perspective view of a life vest equipped with a marker system.
Figure 3:
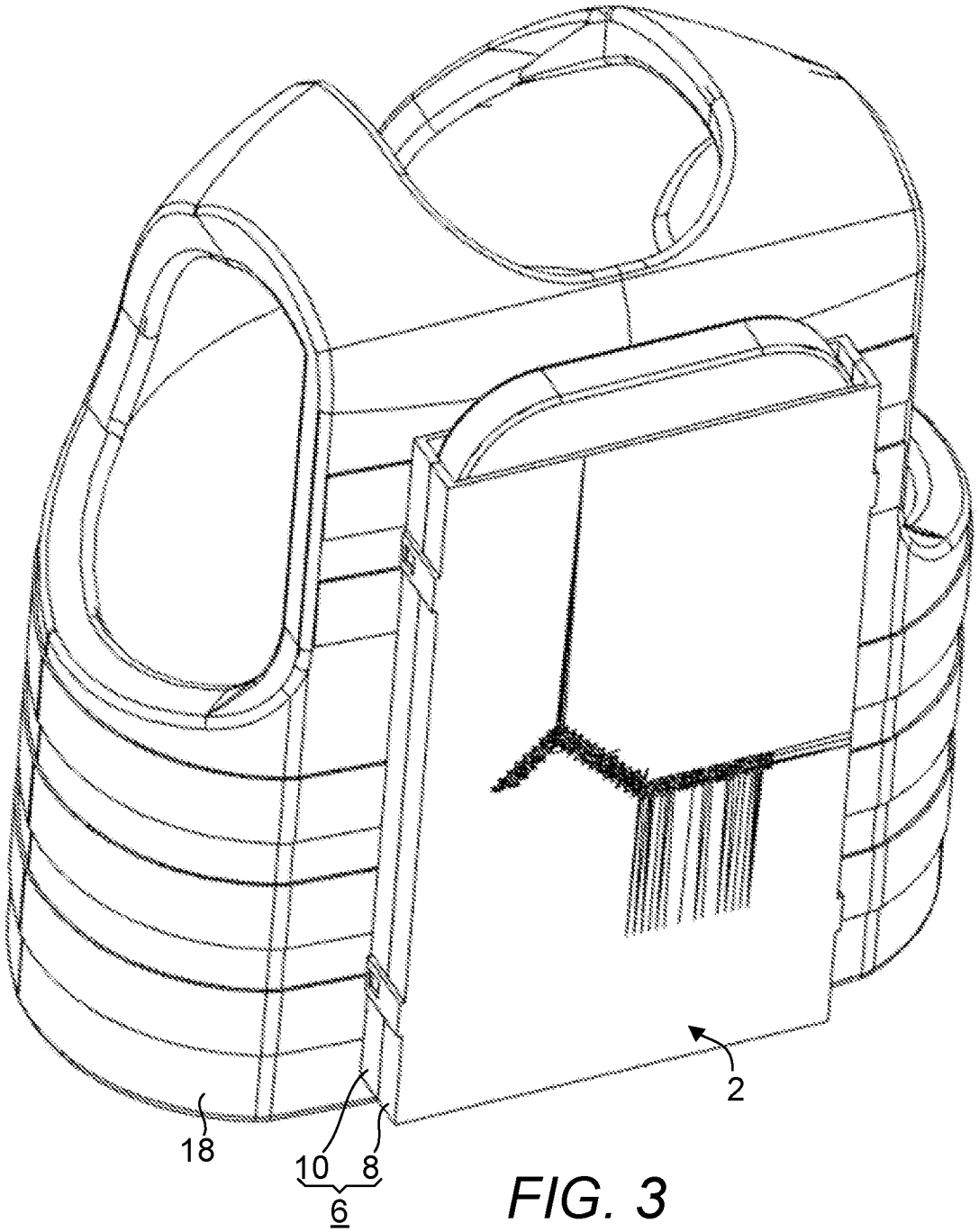
FIG. 3 is a top left rear perspective view of a life vest equipped with a marker system.
Figure 4:
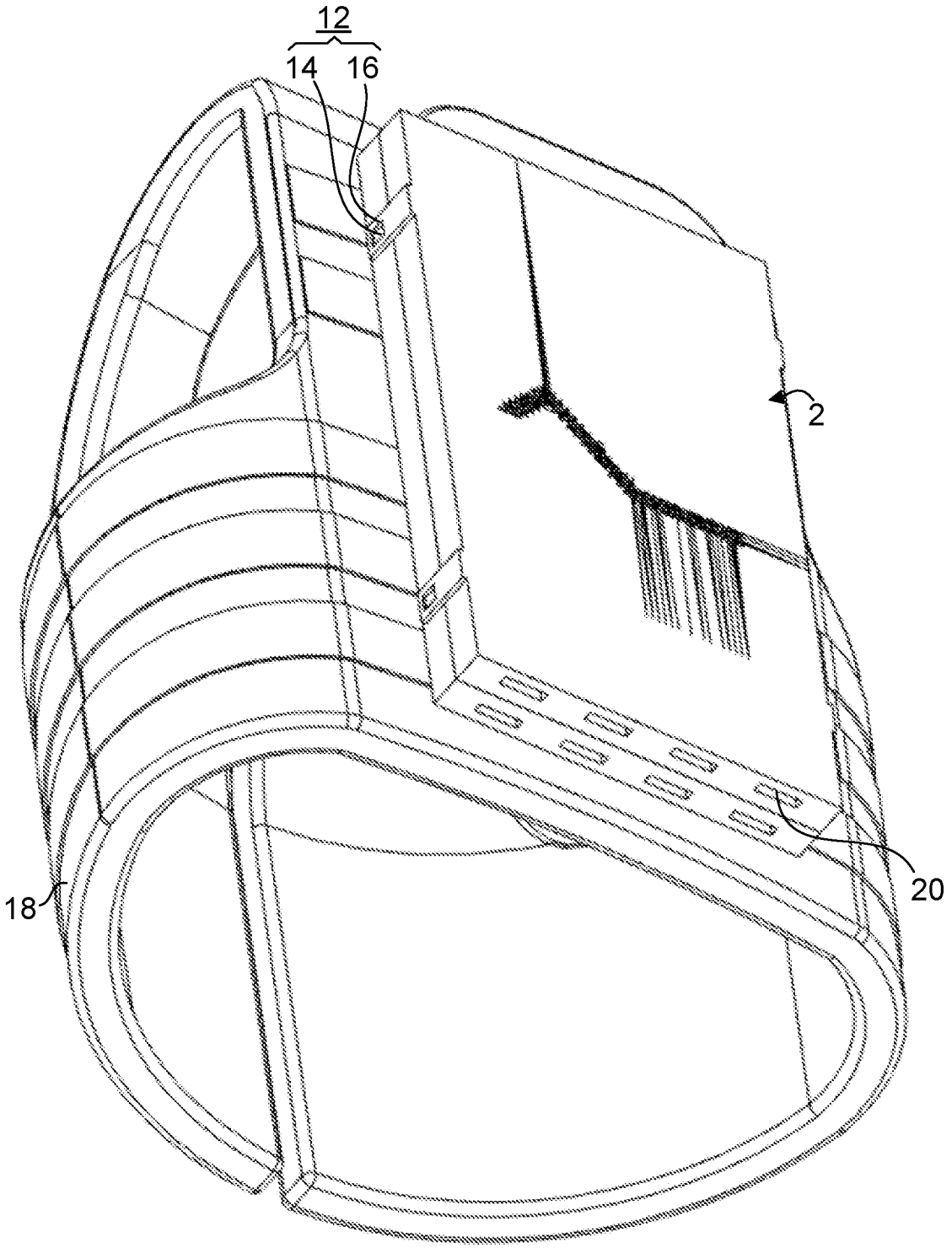
FIG. 4 is a bottom left rear perspective view of a life vest equipped with a marker system.
Figure 5:
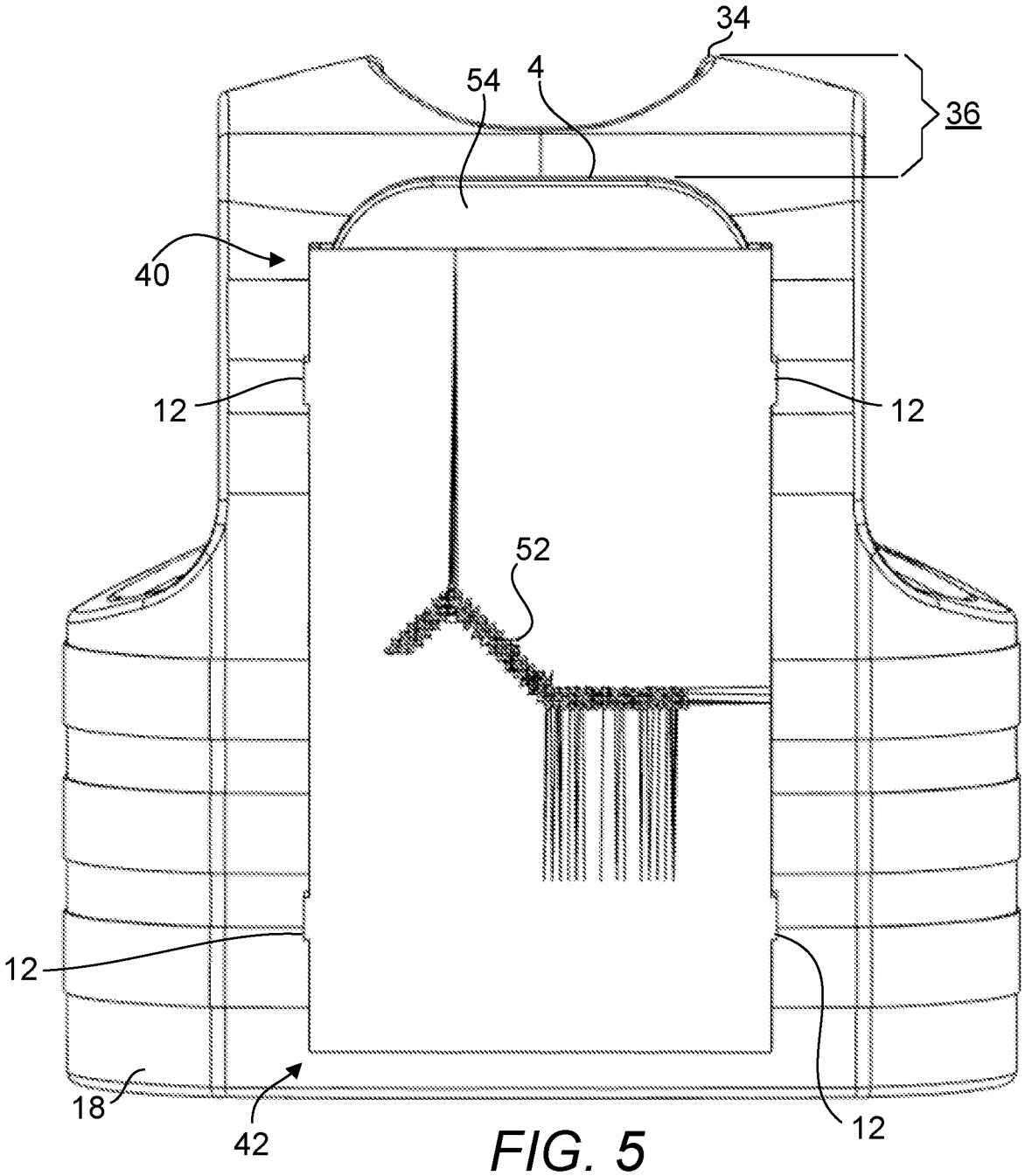
FIG. 5 is a rear view of a life vest equipped with a marker system.
Figure 6:
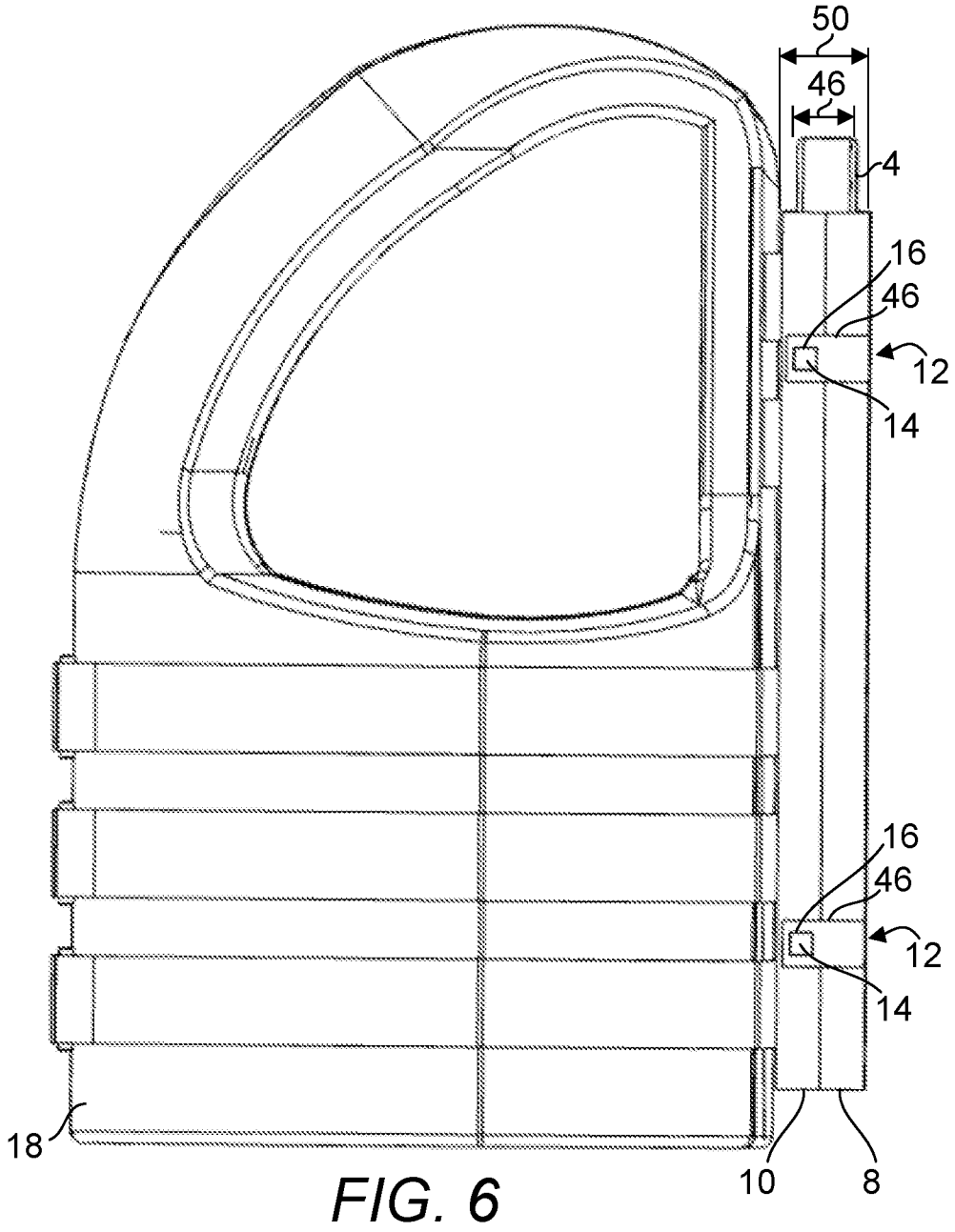
FIG. 6 is a left view of a life vest equipped with a marker system.
Figure 7:
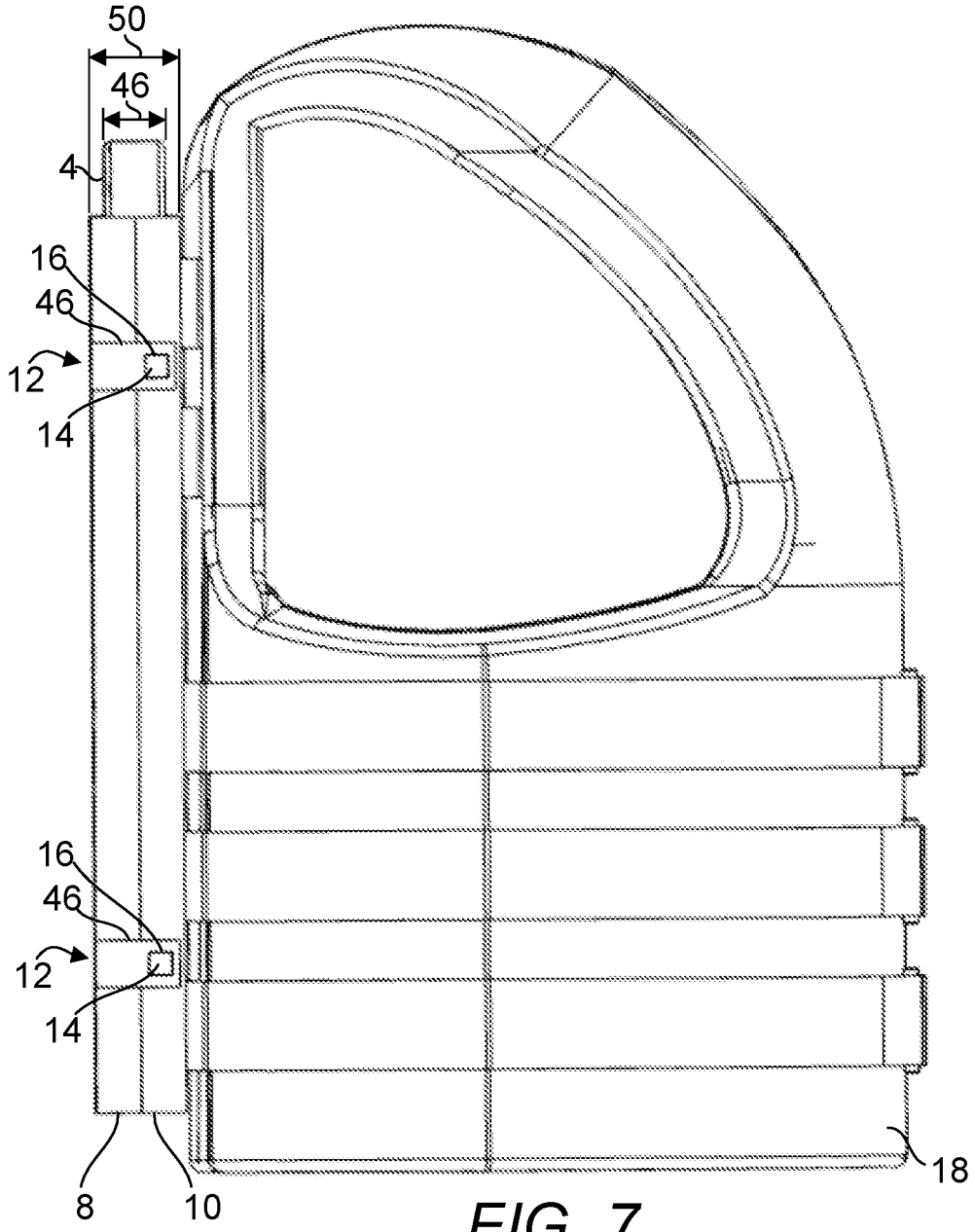
FIG. 7 is a right view of a life vest equipped with a marker system.

FIG. 1 is a top front perspective view of a life vest 18 equipped with a marker system 2. FIG. 2 is a top right rear perspective view of a life vest 18 equipped with a marker system 2. FIG. 3 is a top left rear perspective view of a life vest 18 equipped with a marker system 2. FIG. 4 is a bottom left rear perspective view of a life vest 18 equipped with a marker system 2. FIG. 5 is a rear view of a life vest equipped with a marker system 2. FIG. 6 is a left view of a life vest 18 equipped with a marker system 2. FIG. 7 is a right view of a life vest 18 equipped with a marker system 2. The marker system 2 includes a sleeve 6, a board 4, a plurality of holes 20, an upper end 40 and a lower end 42. The sleeve 6 includes a slot. The slot includes an opening disposed on the upper end 40 of the marker system 2. The board 4 is configured to slide within the slot and through the opening. The holes 20 are disposed on the lower end 42 of the marker system 2 to allow entry of fluid into the slot to urge the board 4 through the opening and exit of the fluid from the slot. The sleeve 6 is configured to be secured to a life vest 18, wherein when the sleeve 6 is disposed in a body of fluid with the opening faces upwardly, the board 4 extends through the opening, serving as a marker to get attention of one or more users around the life vest 18 and when the sleeve 6 is disposed outside of the body of fluid, at least a portion of the fluid entered through the opening and the holes 20, is drained through the holes 20 when the opening faces upwardly to prevent the marker system 2 from taking on additional load due to the fluid. In one embodiment, the minimum ratio of the area of the holes 20 and the volume of the board 4 is about 0.000394 $mm^2$ of the at least one hole/$mm^3$ of the volume of the board or about 0.01 $in^2$ of the at least one hole/$in^3$ of the volume of the board to ensure that the board 4 is raised immediately as soon as the marker system 2 becomes disposed in a body of water. In one embodiment, the thickness 50 of the marker system 2 is no more than about 1.75 inches or 44.45 mm to ensure that the present marker system 2 does not significantly alter the manner in which the life vest 18 to which it is attached, is used. To achieve this and in one embodiment, the thickness 48 of the board 4 is about 0.5-1.1 inches or about 12.7-27.94 mm. Referring to FIG. 5, it shall be noted that, at rest and while not erected, the board 4 stays well below the top edge 34 of the life vest 18, ruling out any interference that the board 4 may have with a user's head when the board 4 is not erected. Note the distance 36 between the top edge 34 of the life vest 18 and the top edge of the board 4. Various markings 52 may be disposed on the front cover 8 for advertising and other commercial or instructional purposes. It is also possible to dispose markings on surface 54, i.e., the front face of the board 4 to make it more obvious to those around the marker system 2.

An exemplary life vest 18 suitable for use with the present marker system 2 is a vest as shown throughout the figures where the vest is generally made of a flotation-capable material, e.g., polystyrene foam, etc., which when disposed on the upper torso of a human, is capable of providing flotation to the human to cause his or her head to be disposed above the body of water the human is immersed in. The jacket 18 may be secured frontally by way of a zipper before strap belts 30 and buckles 32 are used to secure the jacket 18 onto a user.

Figure 8:
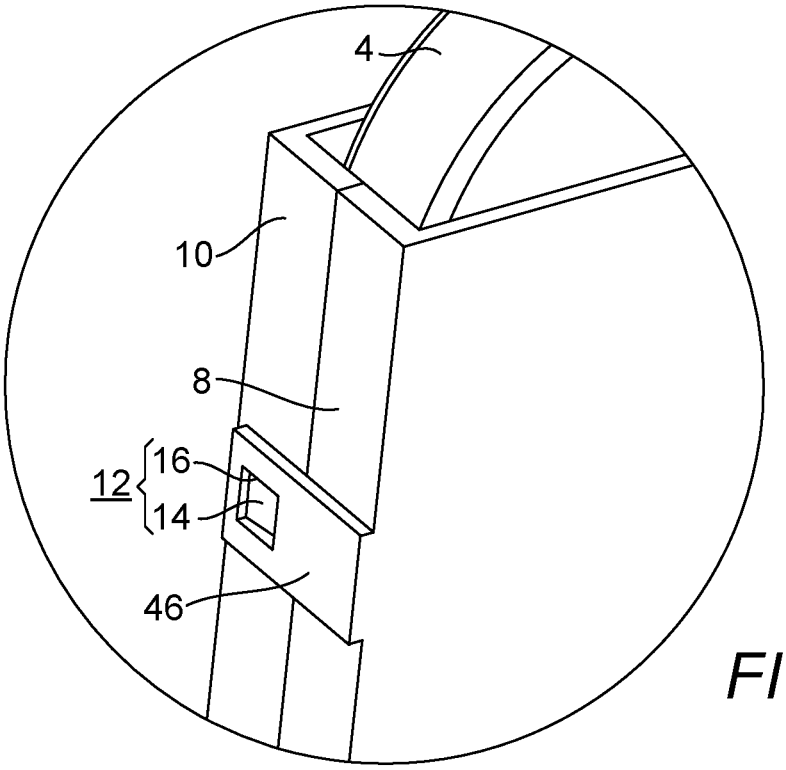
FIG. 8 is a close-up view of a snap-lock disposed in a locked state.
Figure 9:
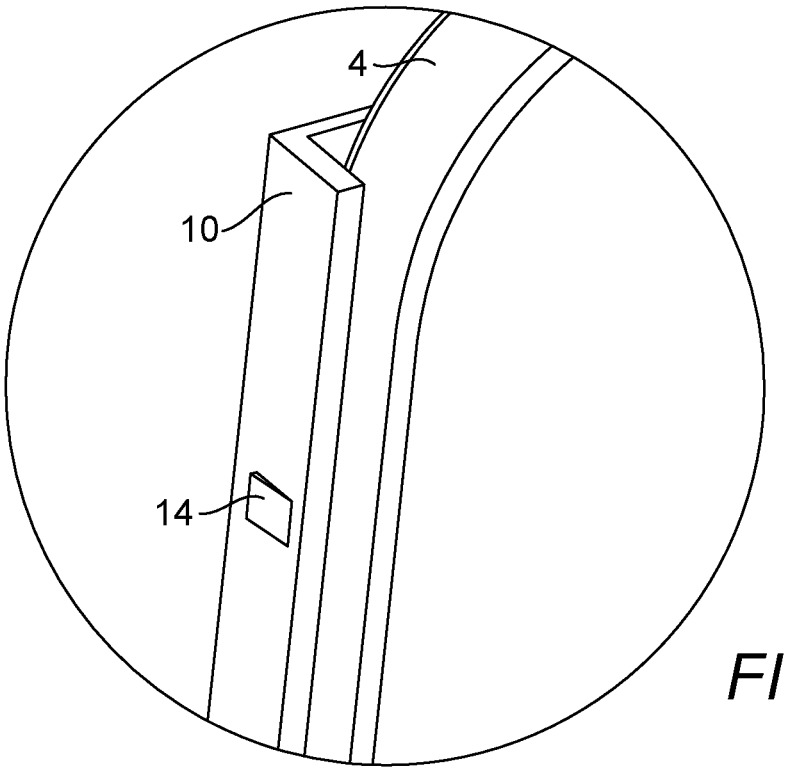
FIG. 9 is a close-up view of a snap-lock disposed in an unlocked state.
Figure 10:
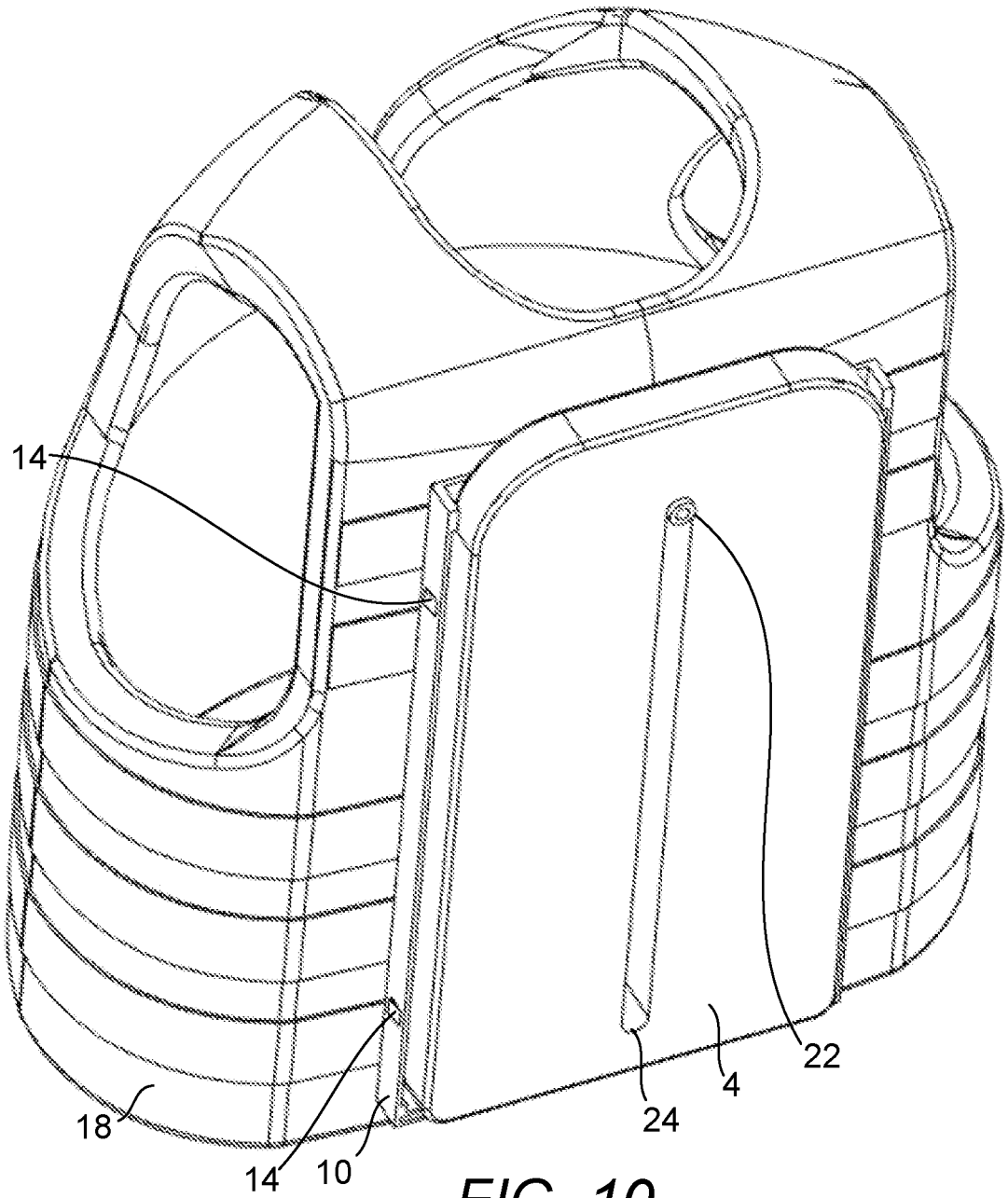
FIG. 10 is a top left rear perspective view of a life vest equipped with a marker system where the front cover is removed to reveal a marker of the marker system, depicting the marker in its at rest position.
Figure 11:
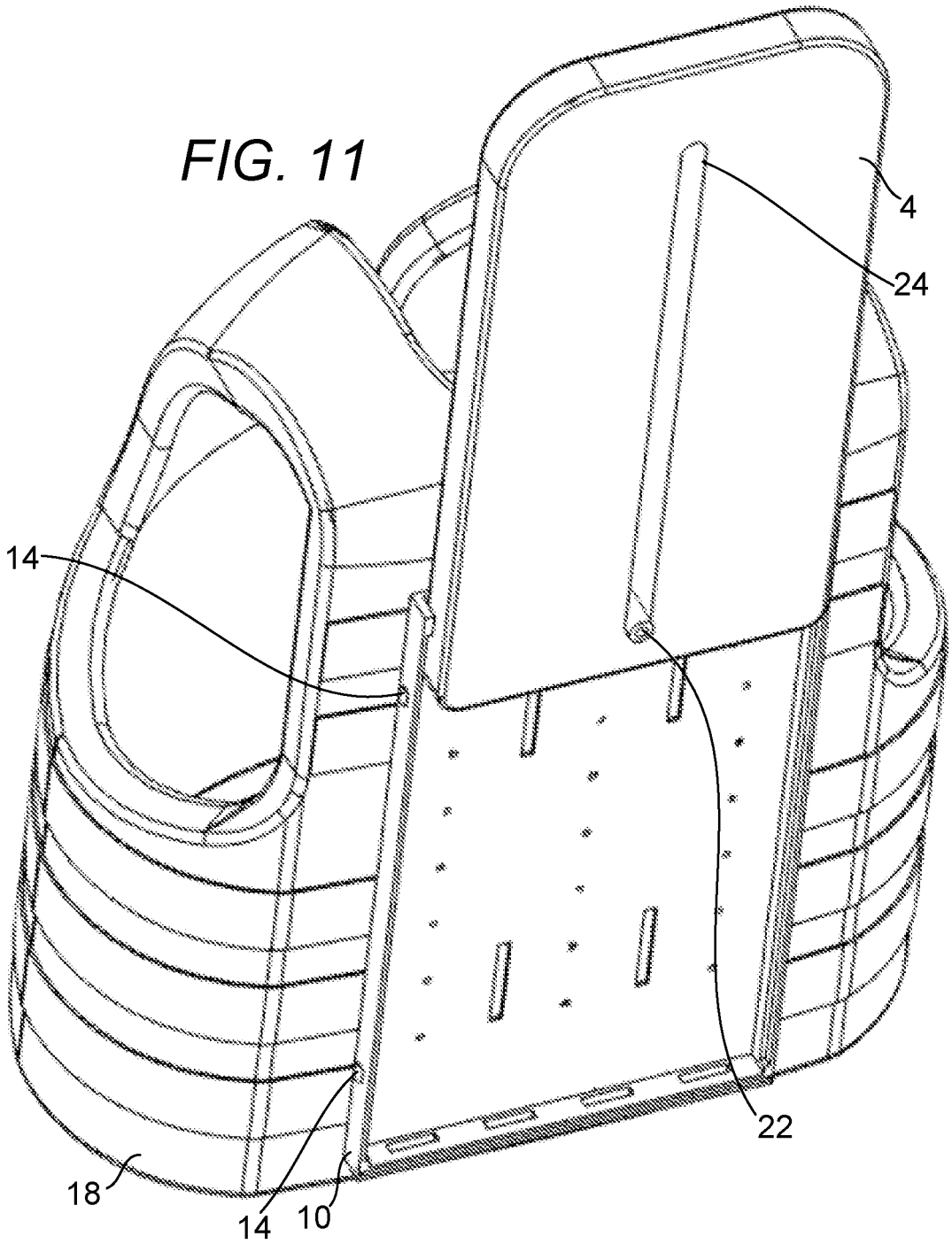
FIG. 11 is a top left rear perspective view of a life vest equipped with a marker system where the front cover is removed to reveal a marker of the marker system, depicting the marker in its erected position.
Figure 12:
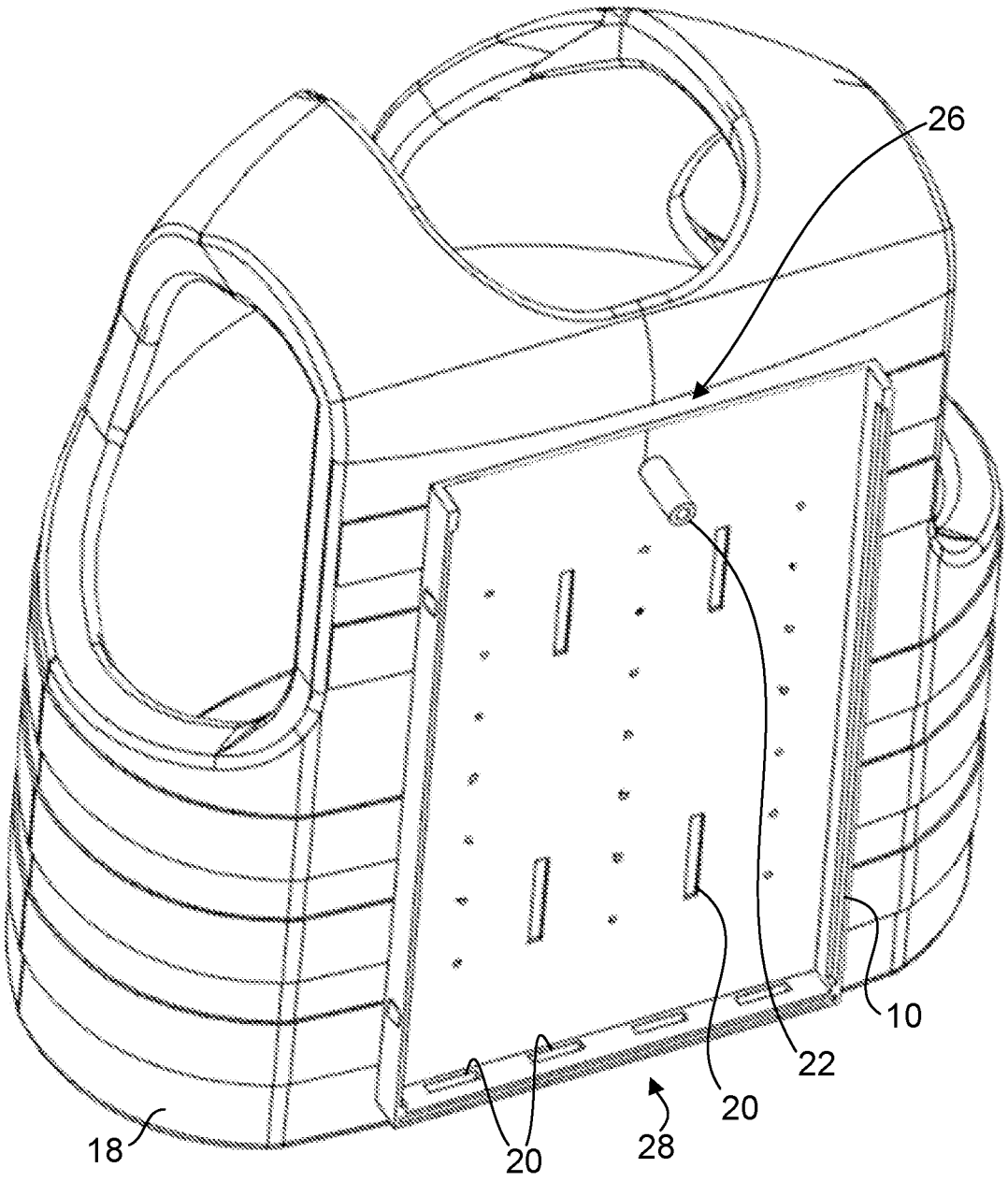
FIG. 12 is a top left rear perspective view of a life vest equipped with a marker system where the front cover and the marker are removed to reveal the rear cover of the marker system.

FIG. 8 is a close-up view of a snap-lock 12 disposed in a locked state. FIG. 9 is a close-up view of a snap-lock 12 disposed in an unlocked state. FIG. 10 is a top left rear perspective view of a life vest equipped with a marker system 2 where the front cover is removed to reveal a marker of the marker system 2, depicting the marker 4 in its at rest position. FIG. 11 is a top left rear perspective view of a life vest 18 equipped with a marker system 2 where the front cover is removed to reveal a marker of the marker system 2, depicting the marker 4 in its erected position. FIG. 12 is a top left rear perspective view of a life vest equipped with a marker system 2 where the front cover 8 and the marker 4 are removed to reveal the rear cover 10 of the marker system 2. The sleeve 6 includes two covers configured to be removably coupled to form the slot with a latch system, a first 8 of the two covers is configured to be removable from a second 10 of the two covers to enable replacement of the board 4. A sold material having a density of no more than about 240 kg/m3 or 15 lb/ft3 has been found to be suitable for providing flotation to the board 4 such that it can be erected, i.e., with the board 4 sliding outwardly through the opening of the sleeve 6 when the marker system 2 is disposed in a body of water. In one embodiment, the latch system includes two pairs of snap locks 12, i.e., an upper pair and a lower pair to facilitate any replacement of the board 4. The board 4 includes a slot 24 disposed substantially in the lengthwise direction of the board 4 and the sleeve 6 includes a retainer 22 configured to be disposed within the slot 24 of the board 4 to prevent detachment of the board 4 from the sleeve 6. The present marker system 2 can function without the slot-retainer mechanism. However, this mechanism is useful for ensuring that the board 4 does not get accidentally removed during use or removed and misplaced while not in use. Referring again to FIG. 10, the retainer 22 is preferably disposed substantially at the upper end 40 of the sleeve 6 and the slot 24 is configured to span substantially the distance between the upper end 40 and the lower end 42 of the sleeve 6, enabling the board to slide a maximum distance substantially the distance between the upper end 40 and the lower end 42 of the sleeve 6. In one embodiment, the retainer 22 is disposed at the upper end 26 of the rear cover. In one embodiment, the retainer 22 may alternatively be disposed at the upper end of the front cover such that a removal of the front cover 8 automatically removes the retainer 22, making it even easier to remove and replace the board 4. It shall be noted that the slot 24 spans substantially the height of the board 4 or a distance from the lower end 28 of the rear cover 10 to the upper end 26 of the rear cover 10, allowing the board 4 to slide a large distance, making it possible for the board 4 visible to passer-bys and those around the user of the marker system 2. In freeing the board 4 for removal, the snap locks 12 are preferably acted upon in pairs although each snap lock 12 may be acted upon singly. In other words, the upper tabs 46 of the upper pair of snap locks 12 should be manipulated or slightly bent with a hand to release their respective slots 16 from their respective snaps 14 before the lower tabs 46 of the lower pair of snap lock 12 are manipulated in a similar fashion to release their respective slots 16 from their respective snaps 14 to completely detach the rear cover 10 from the front cover 8. Referring to FIG. 12, it shall be noted that rear cover 10 may be secured to the life vest 18 by stitching.

Figure 13:
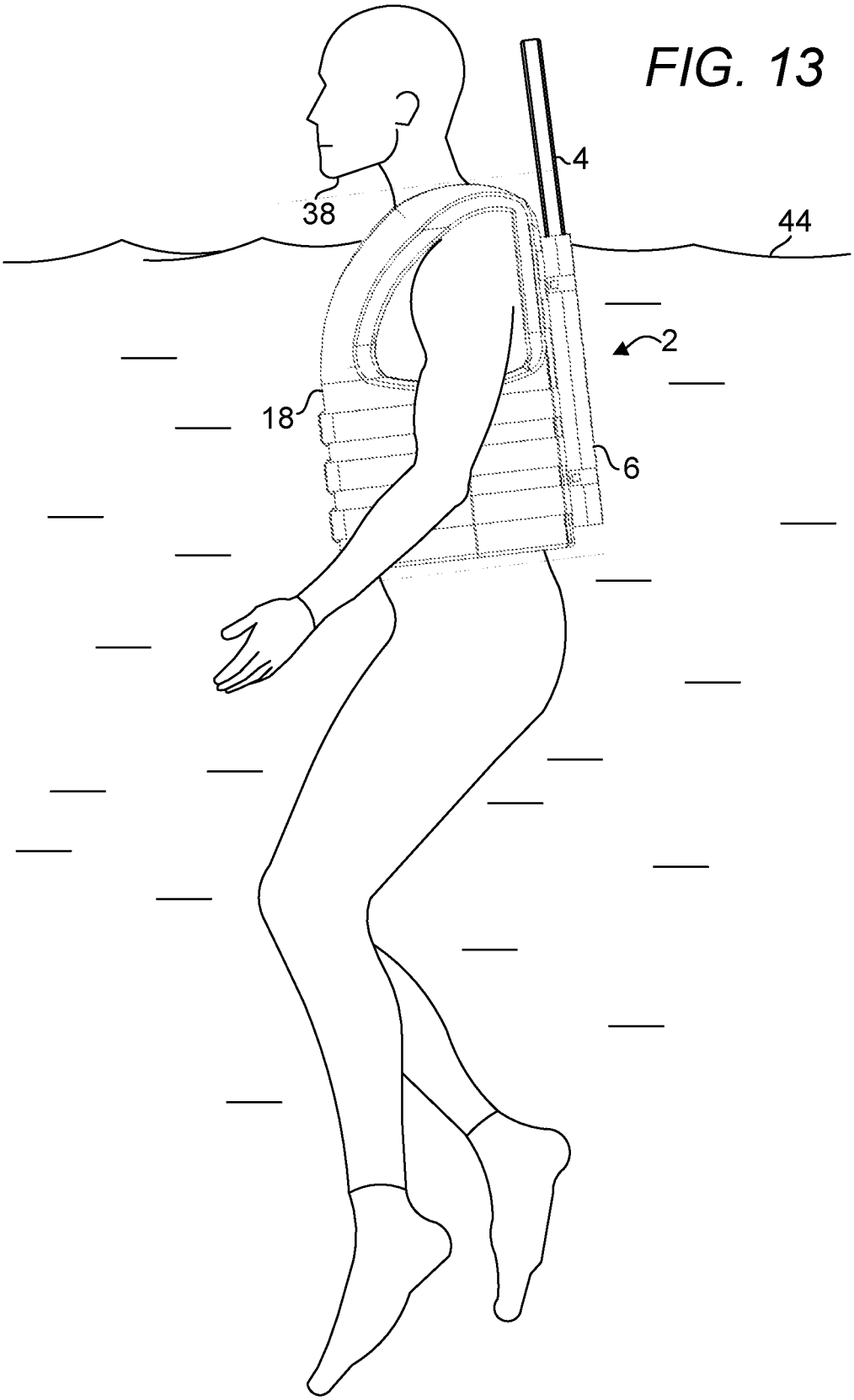
FIG. 13 is a side view of a life vest equipped with a marker system where its marker is disposed in an erected position.
Figure 14:
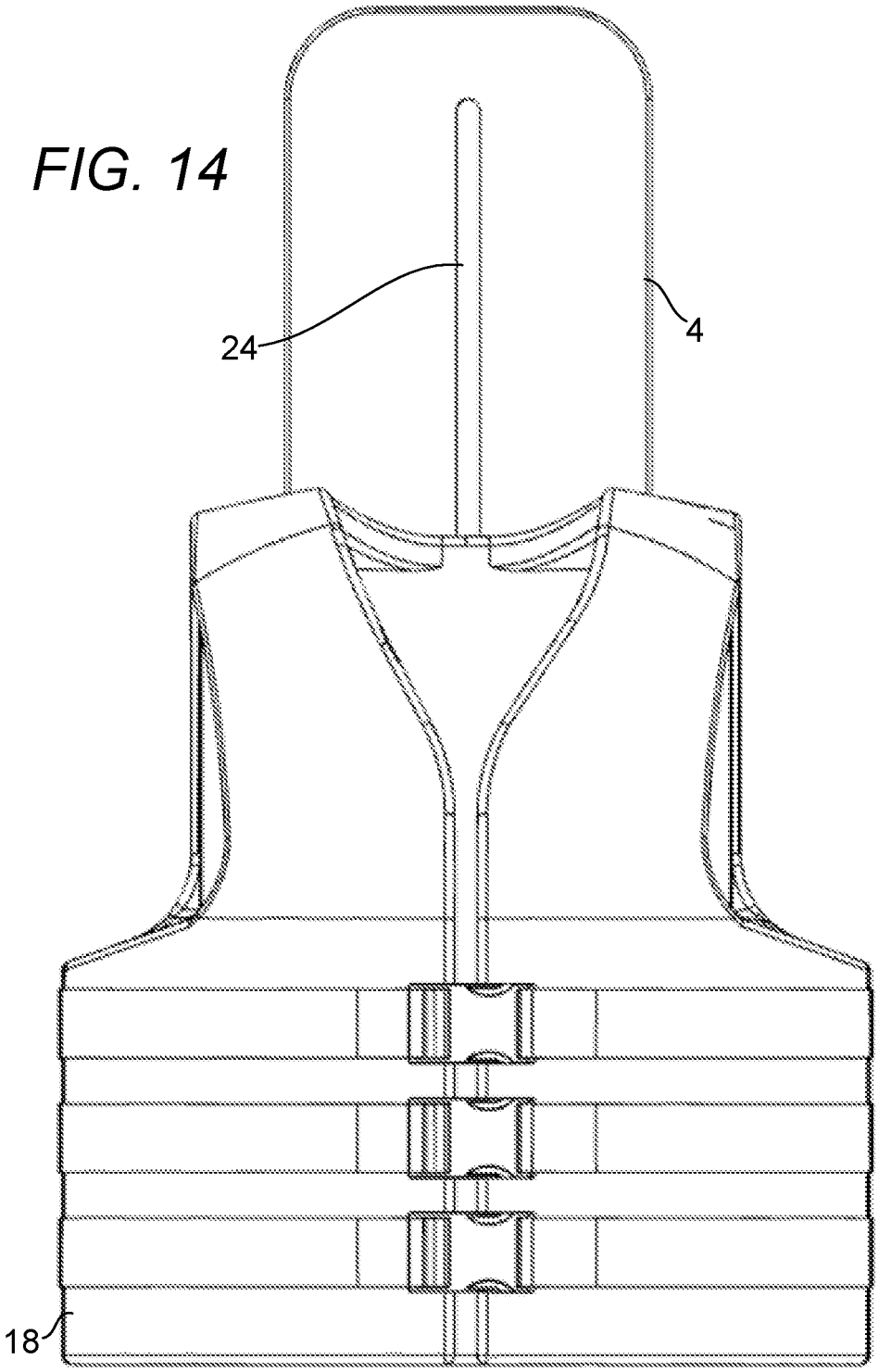
FIG. 14 is a front view of a life vest equipped with a marker system where its marker is disposed in an erected position.
Figure 15:
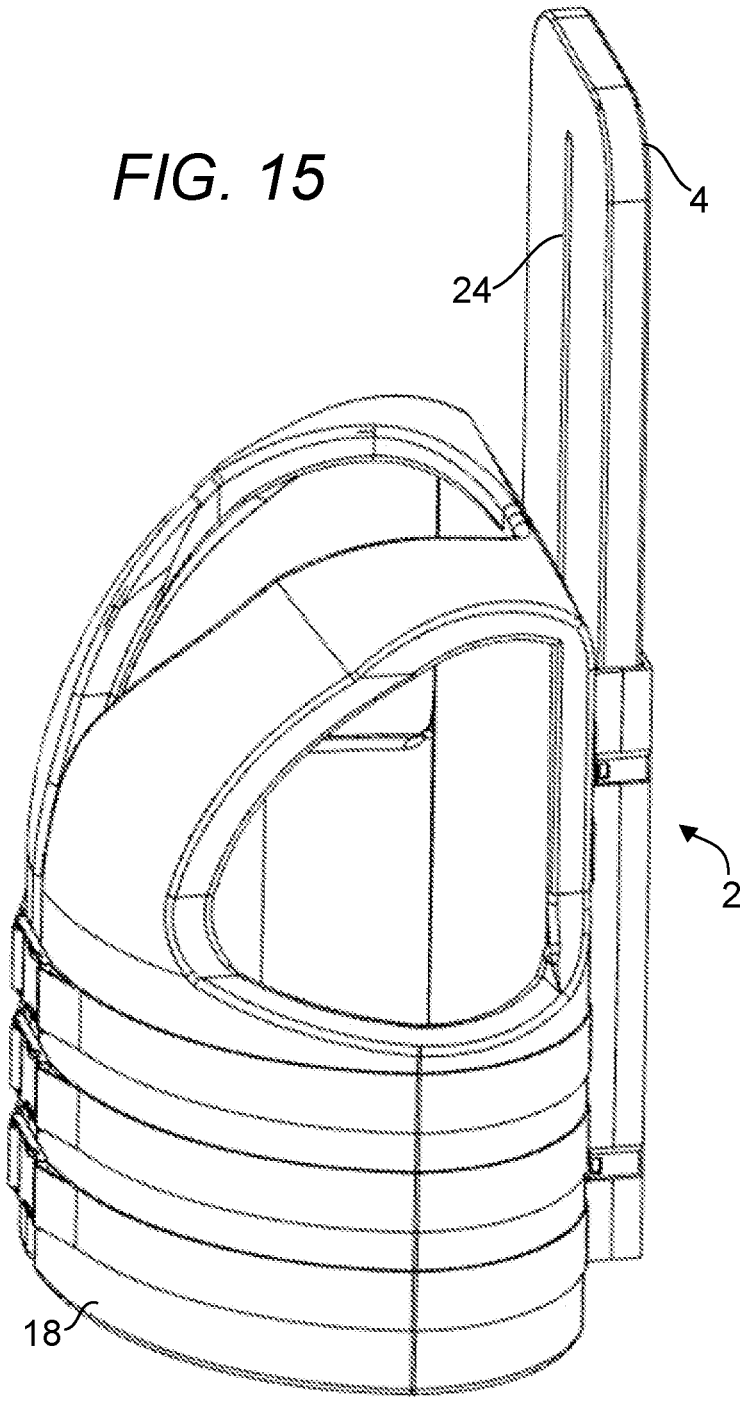
FIG. 15 is a top left front perspective view of a life vest equipped with a marker system where its marker is disposed in an erected position.
Figure 16:
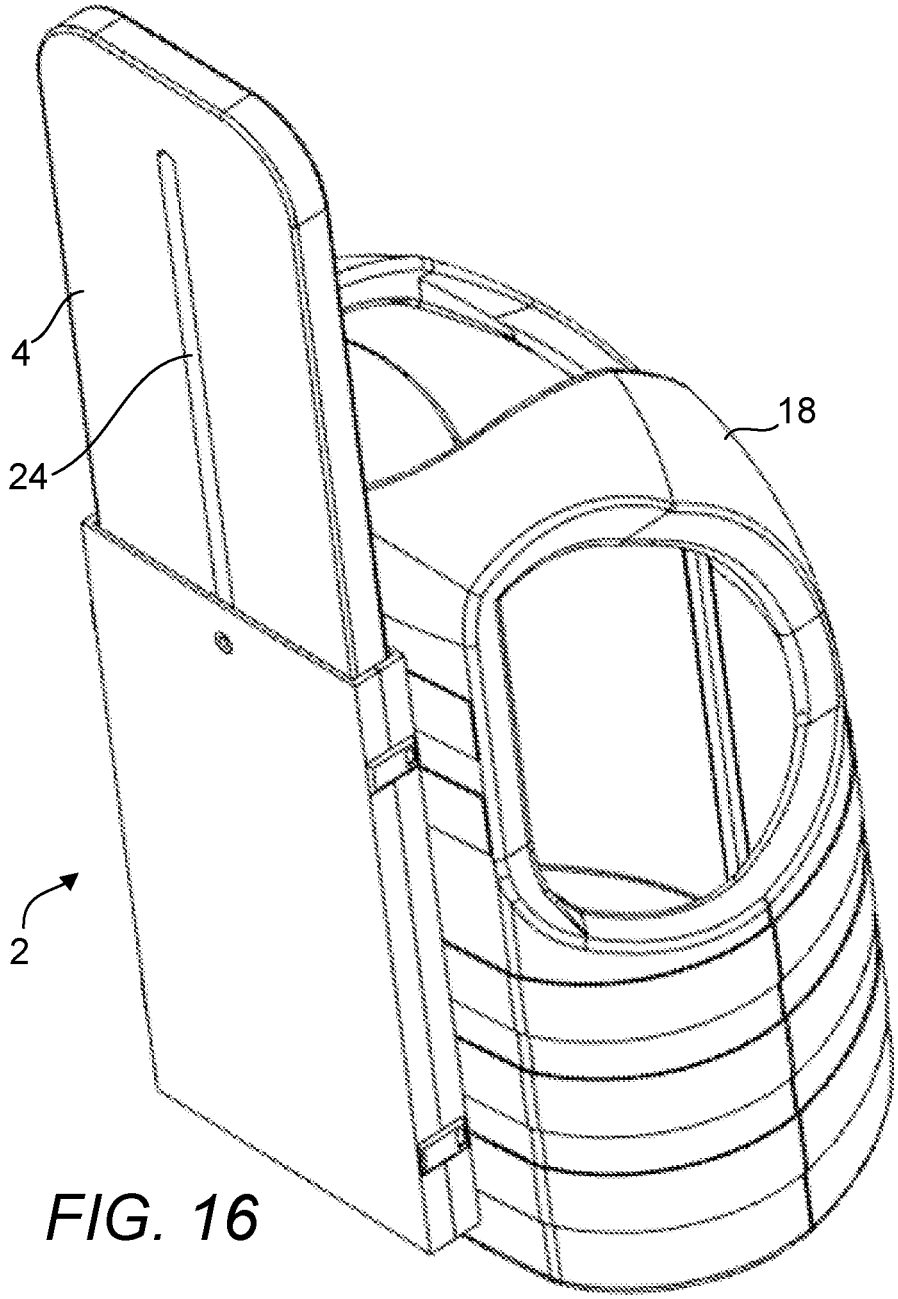
FIG. 16 is a top right rear perspective view of a life vest equipped with a marker system where its marker is disposed in an erected position.

FIG. 13 is a side view of a life vest 18 equipped with a marker system 2 where its marker 4 is disposed in an erected position. The wearer 38 of a life vest 18 equipped with a marker system 2 is shown in an orientation normally dictated by the use of a life vest with the wearer's head maintained above the body of water 44. It shall be noted that the wearer's orientation has not been negatively impacted by the use of the marker system 2 even when the board 4 has been significantly erected to a state capable of catching the attention of a passer-by. FIG. 14 is a front view of a life vest 18 equipped with a marker system 2 where its marker is disposed in an erected position. FIG. 15 is a top left front perspective view of a life vest 18 equipped with a marker system 2 where its marker is disposed in an erected position. FIG. 16 is a top right rear perspective view of a life vest 18 equipped with a marker system 2 where its marker is disposed in an erected position.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A marker system comprising a sleeve comprising a slot, a board, at least one hole, an upper end and a lower end, said slot comprising an opening disposed on said upper end, said board configured to slide within said slot and through said opening, said at least one hole disposed on said lower end to allow entry of fluid into said slot to urge said board through said opening and exit of the fluid from said slot and said sleeve is configured to be secured to a life vest, wherein when said sleeve is disposed in a body of fluid with said opening faces upwardly, said board extends through said opening, serving as a marker to get attention of one or more users around the life vest and when said sleeve is disposed outside of the body of fluid, at least a portion of the fluid is drained through said at least one hole when said opening faces upwardly to prevent said marker system from taking on additional load due to the fluid and said sleeve comprises two covers configured to be removably coupled to form said slot with a latch system, a first of said two covers is configured to be removable from a second of said two covers to enable replacement of said board.

2. The marker system of claim 1, wherein said board comprises a material having a density of no more than about 240 kg/m$^3$ (15 lb/ft$^3$).

3. The marker system of claim 1, wherein said board comprises a slot and said sleeve comprises a retainer configured to be disposed within said slot of said board to prevent detachment of said board from said sleeve.

4. The marker system of claim 3, wherein said retainer is configured to be disposed substantially at said upper end and said slot is configured to span substantially the distance between said upper end and said lower end of said sleeve, enabling said board to slide a maximum distance substantially the distance between said upper end and said lower end of said sleeve.

5. The marker system of claim 1, wherein said latch system comprises a snap lock.

6. The marker system of claim 1, the minimum ratio of the area of said at least one hole and the volume of said board is about 0.000394 mm$^2$ (0.01 in$^2$) of said at least one hole/mm$^3$ (in$^3$) of the volume of said board or about of said at least one hole/of the volume of said board.

7. The marker system of claim 1, wherein said board comprises a thickness of no more than about 1.1 inches (27.94 mm).

8. A marker system comprising a sleeve comprising a slot, a board, at least one hole, an upper end and a lower end, said slot comprising an opening disposed on said upper end, said board configured to slide within said slot and through said opening, said at least one hole disposed on said lower end to allow entry of fluid into said slot to urge said board through said opening and exit of the fluid from said slot and said sleeve is configured to be secured to a life vest, wherein when said sleeve is disposed in a body of fluid with said opening faces upwardly, said board extends through said opening, serving as a marker to get attention of one or more users around the life vest and when said sleeve is disposed outside of the body of fluid, at least a portion of the fluid is drained through said at least one hole when said opening faces upwardly to prevent said marker system from taking on additional load due to the fluid and said board comprises a slot and said sleeve comprises a retainer configured to be disposed within said slot of said board to prevent detachment of said board from said sleeve, said retainer is configured to be disposed substantially at said upper end and said slot is configured to span substantially the distance between said upper end and said lower end of said sleeve, enabling said board to slide a maximum distance substantially the distance between said upper end and said lower end of said sleeve.

9. The marker system of claim 8, wherein said board comprises a material having a density of no more than about 0.000394 $mm^2$ (0.01 $in^2$) of said at least one hole/$mm^3$ ($in^3$) of the volume of said board.

10. The marker system of claim 8, wherein said sleeve comprises two covers configured to be removably coupled to form said slot with a latch system, a first of said two covers is configured to be removable from a second of said two covers to enable replacement of said board.

11. The marker system of claim 10, wherein said latch system comprises a snap lock.

12. The marker system of claim 8, the minimum ratio of the area of said at least one hole and the volume of said board is about 0.000394 $mm^2$ (0.01 $in^2$) of said at least one hole/$mm^3$ ($in^3$) of the volume of said board.

* * * * *